United States Patent [19]

Smead et al.

[11] 4,343,828

[45] Aug. 10, 1982

[54] ELECTRODYNAMIC PAINTING SYSTEM AND METHOD

[75] Inventors: Robert G. Smead, St. Charles; Thomas J. Richards; Charles E. Lanchantin, Jr., both of Peoria, all of Ill.

[73] Assignee: Caterpillar Tractor Co., Peoria, Ill.

[21] Appl. No.: 273,888

[22] PCT Filed: Dec. 24, 1980

[86] PCT No.: PCT/US80/01740

§ 371 Date: Dec. 24, 1980

§ 102(e) Date: Dec. 24, 1980

[87] PCT Pub. No.: WO 82/02154

PCT Pub. Date: Jul. 8, 1982

[51] Int. Cl.[3] ..... B05D 1/04

[52] U.S. Cl. ..... 427/27; 118/621; 118/627; 361/227; 427/33

[58] Field of Search ..... 427/27, 28, 29, 30, 427/31, 32, 33; 118/621, 627; 239/3, 690, 706, 707; 361/225, 226, 227, 228

[56] References Cited

U.S. PATENT DOCUMENTS

| | | | |
|---|---|---|---|
| 2,221,338 | 11/1940 | Wintermote | 427/39 |
| 2,805,642 | 9/1957 | Tuttle et al. | 118/635 |
| 2,894,175 | 7/1959 | Lamm | 361/228 |
| 3,121,024 | 2/1964 | Wampler et al. | 118/2 |
| 3,323,934 | 6/1967 | Point | 117/17 |
| 3,900,000 | 8/1975 | Gallen | 118/630 |
| 3,937,401 | 2/1976 | Luderer et al. | 239/15 |
| 4,230,068 | 10/1980 | Itoh et al. | 118/634 |

FOREIGN PATENT DOCUMENTS

| | | | |
|---|---|---|---|
| 227998 | 11/1958 | Australia | 427/31 |
| 721234 | 11/1965 | Canada | 427/30 |
| 2202960 | 8/1973 | Fed. Rep. of Germany | 427/30 |
| 2734174 | 2/1979 | Fed. Rep. of Germany | 427/27 |
| 538411 | 1/1956 | Italy | 427/30 |
| 1539674 | 3/1977 | United Kingdom . | |

OTHER PUBLICATIONS

A. Ser. No. 18,019—Bagby et al.—filed 3/6/79 now U.S. Pat. No. 4,258,655.

*Primary Examiner*—John H. Newsome
*Attorney, Agent, or Firm*—Richard F. Phillips

[57] ABSTRACT

An electrodynamic spray painting system having a spray gun (13) for spraying paint toward a workpiece (15) and an electrode (16) for causing a charge to be imposed on the paint. A high voltage waveform generator (21) supplies an oscillating voltage to said electrode (16) such that coronas of varying strengths are periodically, controllably generated.

This oscillating voltage enhances the spectrum of charges on the paint particles improving evenness of coverage of paint on the workpiece (15). Additionally, wastage of paint is decreased. This invention is also applicable to other coating materials, such as powders.

29 Claims, 8 Drawing Figures

ELECTRODYNAMIC PAINTING SYSTEM AND METHOD

Technical Field

This invention relates generally to spray painting systems and more particularly to spray painting systems utilizing electric fields for improved paint coverage.

BACKGROUND ART

Industry has long utilized various spray coating systems for the application to surfaces of coating materials such as paints, adhering powders and the like. Two great disadvantages are inherent to most of these systems. First, much of the material to be applied is wasted, owing to failure to reach the surface or adhere to the surface. Second, irregular surfaces were often not adequately covered; recesses, for example, have proven especially difficult to coat.

Various improvements of the basic spray system have been developed, most with the goal of decreasing the amount of coating material wasted and/or improving the evenness of coverage of the coating material. Possibly the most significant of these has been the use of electric fields for influencing the trajectory of particles of the coating material as they move in the direction of the surface to be coated. Such systems to date have depended upon the imposition of static electric fields, for example, between the element from which the coating material issues and the surface to be coated, to charge the particles of the coating material and to subsequently control their trajectories. These are known as electrostatic spray systems.

Prior electrostatic systems have been generally of three types. In the first, paint is sprayed past an electrode to which a D.C. voltage is applied. A portion of the paint particles accept a charge from the electrode and are then electrically attracted to an oppositely charged workpiece. In another, a conductive-paint system, having a bulk paint supply, paint pump and delivery conduits, is maintained at the electrostatic charging potential, as, for example, 50 kv to 100 kv. The charged paint system must be protected from access by the operator, complicating servicing of the supply, replenishment of paint and changing of paint color. Also, the electrical energy stored in the charged paint system presents a danger of fire or explosion in the event of a short circuit. The third system grounds the paint supply and spray gun while maintaining the article being coated at an electrical potential of the order of 100 kv. The paint particles are not electrically charged on formation at the gun and the higher efficiency of paint deposition associated with charging the paint particles is not achieved.

Electrostatic spray systems, though a significant improvement over electrically neutral systems, do not adequately coat many highly irregular surfaces. Many electrostatic spray coating operations rely on a final manually directed, non-electrostatic application of coating material to provide acceptable coverage of recessed areas of the surface being treated.

The present invention is directed to overcoming one or more of the problems as set forth above.

DISCLOSURE OF THE INVENTION

In one aspect of the present invention, an electrodynamic coating apparatus has first means for propelling a plurality of particles of a coating material toward a workpiece. A second means is provided for imparting a charge of time-varying magnitude to at least one of said workpiece and said particles.

In another aspect of the present invention, a method for coating a workpiece comprises the steps of charging a workpiece, spraying a coating material toward the workpiece, and exposing the coating material to a time varying electric field.

Spray coating systems typically suffer from uneven coating of the workpiece and wastage of coating material. In partial solution of these problems, the prior art positions an electrode proximate a nozzle from which coating material issues. This electrode is charged to a constant potential to establish an electric field for charging the particles of the coating material. A charge may also be imposed on the workpiece. The resulting electric field surrounding the workpiece controls the trajectories of the particles resulting in improved evenness of coverage and decreasing wastage. In the present invention, the charge on at least one of the electrode and the workpiece is varied with time further improving evenness of coverage and decreasing wastage.

BEST MODE FOR CARRYING OUT THE INVENTION

Figure 1:
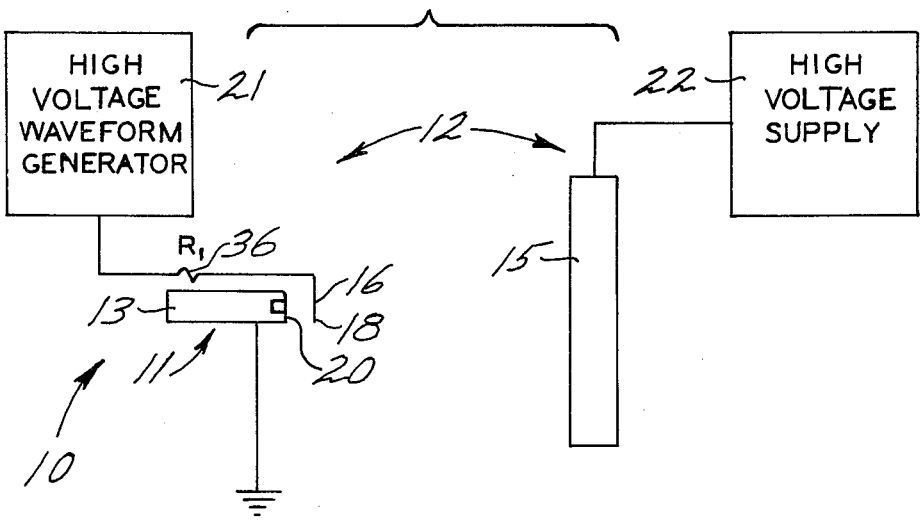
FIG. 1 is a schematic of an embodiment of the present invention.

Referring more particularly to the drawings, an electrodynamic painting system embodying the principles of the present invention is generally indicated by the reference numeral 10. As shown schematically in FIGS. 1 and 5, the present invention includes a mechanical spraying portion 11 and an electrical charging portion 12. In the mechanical spraying portion 11, a gun 13 serves to atomize and project a coating material, such as paint or powder, from a pressurized supply source 14 and form a fine stream of particles of this material for coating a workpiece 15 positioned a spaced distance from the gun 13. The electrical charging portion 12 of the present invention includes an electrode 16 having a tip 18 connected to the gun 13 such that the tip 18 is spaced a small distance from an outlet end 20 of the gun 13. The electrode 16 is charged by a predetermined voltage waveform established by a high voltage waveform generator 21 (by "high voltage", voltage in excess of about 1 kV is meant). Maintaining the electrode 16 at a high voltage causes the particles of paint or powder to be charged. Desirably, control of the particle trajectories to the workpiece 15 may be controlled by electric fields established by the charged electrode 16 and by a charge maintained on the workpiece 15 by a workpiece high voltage supply 22.

Figure 2:
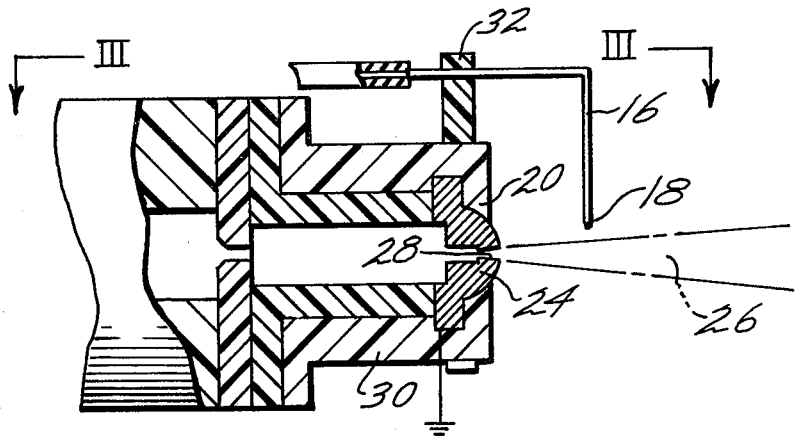
FIG. 2 is a cut away side view of the projection end of the spray gun.
Figure 3:
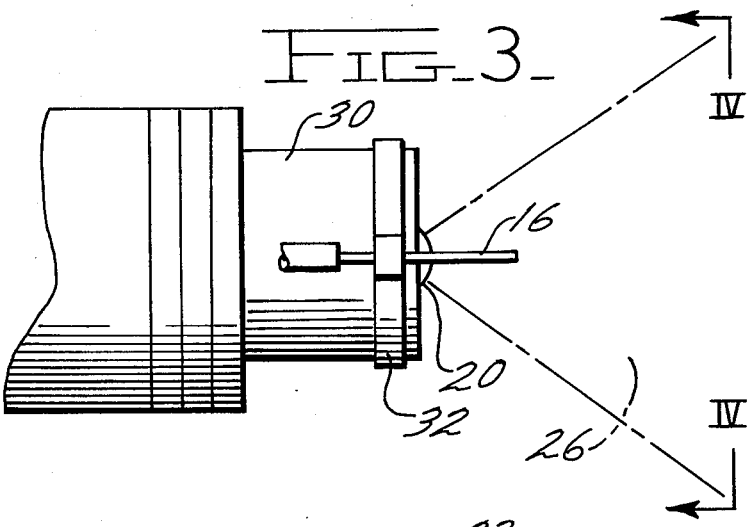
FIG. 3 is a top view of the projection end of the spray gun taken along line III—III of FIG. 2.

FIG. 2 more clearly details the outlet end 20 of the gun 13. Paint from the pressurized supply source 14 (FIG. 5) is discharged from a conductive nozzle 24 of the gun 13, interacts with the surrounding air, and breaks into small particles and forms an expanding spray pattern 26 having a cross-sectional shape determined primarily by the geometry of an orifice 28 in the nozzle 24. Preferably, as shown best in FIG. 4, the orifice 28 is generally of a slot configuration, the major axis of which extends substantially perpendicularly to the electrode 16. The particles are projected through the pressure gradient existing at the orifice 28 and subsequently follow a path along the axis of the gun 13 toward the workpiece 15. The size of the paint particles and their distribution along the gun axis are established by such factors as the paint viscosity and surface tension, the discharge pressure and the geometry of the nozzle orifice 28. Additional mechanical details of spray guns are well known to those skilled in the art.

Figure 4:
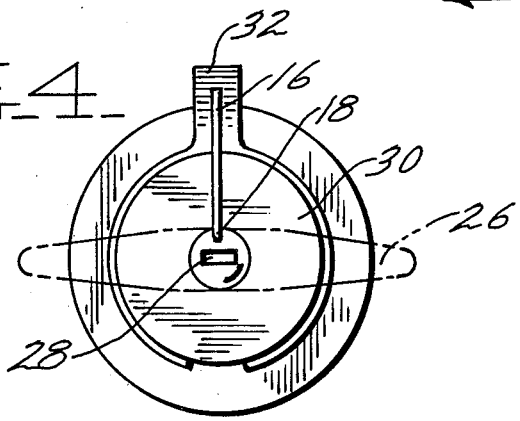
FIG. 4 is a front view of the projection end of the spray gun taken along line IV—IV of FIG. 3.

The electrode 16 is mounted on a generally non-conductive annular body or barrel 30 of the gun 13. It is important that the resistance between the electrode and ground, via the gun barrel 30 to which it is attached, be very large, preferably in excess of $10^{10}$ ohms. This is aided by mounting the electrode 16 on an insulating sleeve 32 so that the electrode 16 is spaced a distance from the barrel 30. As best shown in FIGS. 2 and 4, the electrode 16 is a slender wire the tip 18 of which is adjacent but outside the concentrated spray pattern 26. In the preferred embodiment, the nozzle 24 is grounded. In certain other applications, it may be advantageous to float the nozzle 24.

The electrode 16 is preferably formed of 0.74 mm wire and extends forward of the face of the gun a distance in the range of about 12–25 mm. The tip 18 of the electrode 16 is spaced from the concentrated paint particle spray pattern 26 less than 12 mm. It is important, however, that the electrode 16 be sufficiently far from the spray pattern 26 that it remains substantially free from a harmful buildup of paint.

Figure 5:
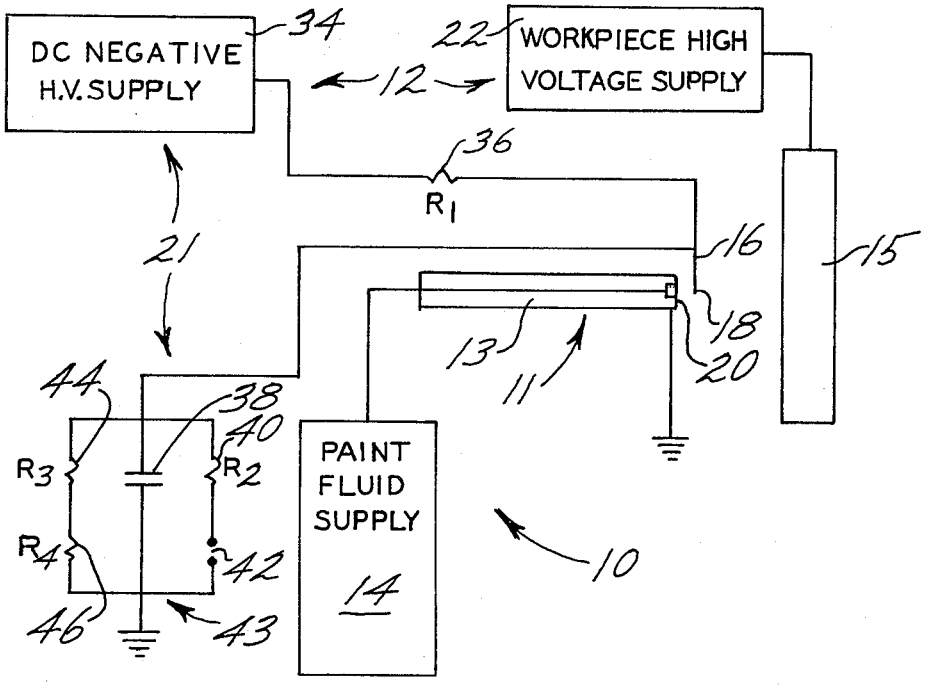
FIG. 5 is a schematic of a preferred embodiment of the present invention.

The electrical charging portion 12 of the present invention can assume a number of different forms. A preferred embodiment of this electrical charging portion 12 is shown in FIG. 5. The high voltage waveform generator 21 includes a D.C. negative high voltage supply 34 providing a maximum voltage of about −30 kV to the electrode 16 through a first current limiting resistor 36. The maximum voltage supplied to the electrode must be sufficient to establish a strong corona in the vicinity of the electrode tip 18. Also connected to the electrode 16 is one terminal of a variable capacitor 38, preferably rated at 2–20 nF. The other terminal of this capacitor 38 is grounded. Connected in parallel across the terminals of the capacitor 38 is a series combination of a variable second resistor 40 and a variable point to sphere air gap 42. The capacitor 38, the second resistor 40 and the air gap 42 form a discharge circuit 43. Preferably, the time constant of this discharge circuit 43 is between 0 and 2 seconds, providing rapid variations in voltage. It is further preferable that the period of the voltage variance be between 0 and 2 seconds. A value of about 1 second has been found to be advantageous.

Connected in parallel with the capacitor 38 is a series combination of a third resistor 44 and a fourth resistor 46. The third resistor 44 must be large with respect to the first current limiting resistor 36, preferably 1 Gigohm. The fourth resistor 46 must be small with respect to the third resistor 44, preferably 0.6 Megohm. An oscilloscope can be connected across the fourth resistor 46 for observing the waveform of the voltage across the fourth resistor 46. This observed voltage can be related to the voltage at the electrode 16 in a manner well known to those skilled in the electrical arts.

The preferred setting for the capacitor 38 is 6 nF, for the variable resistor 40 it is 5 Megohms, for the current limiting resistor 36 it is 25 Megohms for the air gap 42 it is a distance sufficient that breakdown occurs approximately at an application of 30 kV to the electrode 16. This distance will be in the range of about 1–10 mm.

In this system it is preferable to ground the nozzle 24 and charge the workpiece 15 to a very high positive potential with the workpiece high voltage supply 22. This workpiece high voltage supply 22 can be a D.C. source providing +100 kV to the workpiece 15. Means for insulating the workpiece from ground so as to maintain a charge thereon without undue consumption of energy or sparking is well known to those skilled in the art.

In an alternative embodiment of the present invention, the voltage is varied on the workpiece 15 rather than that on the electrode 16. In this embodiment, the voltage on the electrode 16 is maintained at a negative potential sufficient in magnitude to produce a continuous corona through which at least a portion of the paint particles pass. A voltage of between −12 and −20 kV suffices for this purpose. A workpiece high voltage waveform generator constitutes the high voltage supply 22 of FIG. 1. This supply may be generally similar in construction to that described previously for applying a varying voltage to the electrode 16. It is advantageous in this embodiment, however, that the high voltage supply apply to the workpiece a maximum voltage of approximately +100 kV. Consequently, a D.C. voltage source of at least +100 kV is utilized in this embodiment. Additionally, the point-to-sphere air gap 42 is increased so that discharge occurs at approximately 100 kV rather than the 30 kV previously detailed.

In another embodiment of the present invention, the voltages applied to the workpiece 15 and the electrode 16 are both varied. In this embodiment the frequencies of the two voltage supplies can be matched and the phase differences between the two voltage wave trains adjusted to optimize coverage. Generally, however, such synchronization is only of advantage for the case in which the time of paint particle travel from the gun 13 to the workpiece 15 is no more than approximately one order of magnitude greater than the period of voltage applied to the electrode 16.

Figure 7:
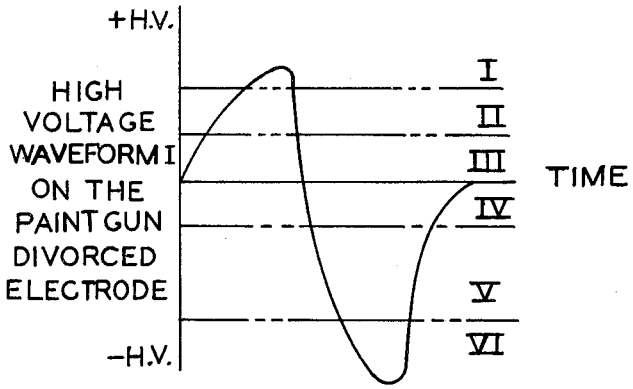
FIG. 7 is a graph showing an advantageous voltage waveform for the electrode, the voltage axis is not to scale.
Figure 8:
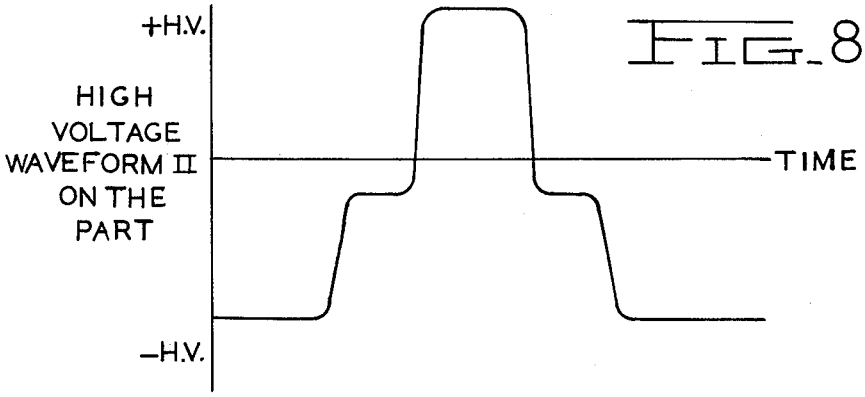
FIG. 8 is a graph showing an advantageous voltage waveform for the workpiece.

In the embodiments described above, the voltage waveform generators 21,22 described can be replaced with a solid state arcless generator. Ideally, such a generator can be programmed to produce substantially any waveform at any desired frequency. Advantageous waveforms for the electrode and workpiece voltages are depicted in FIGS. 7 and 8 respectively. Preferably, the waveform of FIG. 7 extends from +40 kV to −30 kV, and the waveform of FIG. 8 extends from +100 kV to −100 kV. The most advantageous frequency for each is in the range of about 0.5–40 Hz. More simply, alternating voltage of sufficiently great magnitude (+40 kV for the electrode and +100 kV for the workpiece) can be employed in the described embodiments.

In such case, the voltage waveform generators 21,22 can comprise step-up transformers. Similarly, thyrister or thyratron switching circuitry could be used to obtain an arcless varying voltage supply.

In this invention it is important to produce a time varying electric field in the vicinity of the nozzle 24. This could be accomplished as described above or by maintaining the electrode 16 at a constant potential and varying the voltage of the nozzle 16.

INDUSTRIAL APPLICABILITY

The present invention appears to be best suited for spray painting large complex parts and assemblies. It may be utilized with either water-based or organic solvent based paints, powders and the like.

Briefly, it is our belief that the charged electrode 16 induces a surface charge on the nozzle 24 that is of opposite polarity to the charge on the electrode 16. As paint particles issue from the nozzle 24, they gain a charge of like polarity to that of the nozzle 24. For a voltage varying electrode 16, an electric field in the vicinity of the electrode 16 periodically builds to a level at which a corona is established. The corona is a region of oxygen molecules ionized to a charge of like polarity to that of the electrode 16. That portion of the spray 26 passing through the corona will accept a certain number of the ionized oxygen molecules resulting in the spray 26 having charges of both polarities and a variety of magnitudes. Assuming a negatively charged electrode 16, those particles passing most deeply through the corona will be the most electrically negative. Those avoiding the corona will retain the positive charge accepted from the nozzle 24. Particles passing through the fringe of the corona may have little or no charge. In the best mode, this charge-spectrum of paint particles varies not only with position in the spray cross-section, but also with time. At one point in the voltage cycle of the electrode 16 there may be a strong negative corona, creating a majority of negatively charged particles. A quarter cycle later the electrode 16 can still be negatively charged, but at a level sufficiently low such that no corona exists. Consequently most of the paint particles then in the region of the electrode 16 will be positive having accepted an induced positive charge owing to the electric field between the electrode 16 and the nozzle. This cyclic variation, coupled with a reciprocating movement of the gun with respect to the workpiece, ensures that each portion of the workpiece 15 is exposed to positive, negative and neutral particles. It is this enhancement of the particle charge spectrum that constitutes one of the advantages of the present invention.

Figure 6:
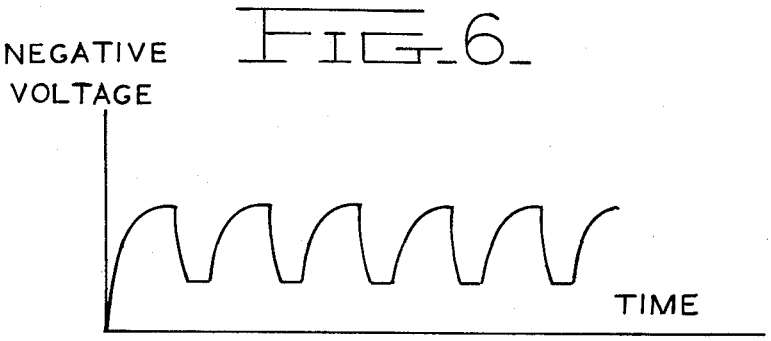
FIG. 6 is a graph showing a voltage waveform at the electrode corresponding to the high voltage waveform generator of FIG. 5.

FIG. 7 shows a possible high voltage waveform for the electrode 16. Regions I and VI are, respectively, strong positive and negative corona regions in which virtually the entire spray issuing from the nozzle 24 is strongly charged to the same polarity as the electrode 16. In regions II and V the corona does not dominate, but does influence a portion of the particles. In regions III and IV the applied voltage is too low to support a corona and, consequently, all the particles then issuing from the nozzle receive an induced charge opposite that of the electrode 16 or remain neutral. FIG. 6 details the position of these regions for the actual voltage waveform obtained with the electrical charging portion 12 of the preferred embodiment of the present invention. By controlling the length of time of output voltage in each zone, the number of droplets with a given charge can be controlled. The optimum spectrum is a function primarily of the recessed fraction and wrap around fraction of the workpiece surface.

Analogously, as detailed for one of the alternative embodiments, the voltage on the workpiece 15 can be varied. The optimum variation in voltage is controlled by the recessed fraction and wrap around fraction of the workpiece surface. Consequently, the optimum waveform is a function of the shape of the workpiece 15.

More specifically, particles having the same polarity as the workpiece 15 are slowed as they approach the workpiece surface in response to interaction of their respective like charges. However, since the particle charge is relatively weak with respect to the workpiece charge, the momentum of the particle is generally sufficient to resist repulsion once the particle is directed toward the workpiece 15. In particular, it has been found that this species is resistant to deposition on a highly charged edge surrounding a recess and will usually penetrate the recess to a much greater extent and the oppositely charged or neutral particles.

For the preferred embodiment of FIG. 5, the voltage waveform at the electrode 16 is controlled. The rate at which the capacitor 38 is charged can be increased by decreasing the value of the current limiting resistor 36 or decreasing the value of the capacitor 38. The maximum voltage applied to the electrode 16 can be increased by increasing the air gap 42. The rate at which the capacitor 38 is discharged can be increased by decreasing the value of the capacitor 38 or decreasing the value of the second resistor 40. The values of these elements may consequently be controlled to vary the maximum magnitude of the voltage generated and the approximate frequency and shape of the waveform.

Other aspects, objects, advantages and uses of the present invention can be obtained from a study of the drawings, the disclosure, and the appended claims.

We claim:

1. In an electrodynamic coating apparatus (10) for coating a workpiece (15) with a coating material, said apparatus (10) having first means (13) for propelling a plurality of atomized particles of said coating material through space in a preselected spray pattern (26), said first means (13) having a gun body (30) and a nozzle (24) connected to the gun body (30), the improvement comprising:

a second means (16,34) including an electrically chargeable electrode (16) for establishing an electric field intermediate the nozzle (24) and the electrode (16) for imparting an initial electrical charge of one polarity to the plurality of atomized particles at the nozzle (24), and for establishing, in response to the electrode (16) being charged to a sufficiently great first level, a zone of ions of an opposite polarity to said one polarity in the pathway of at least a portion of the preselected spray pattern (26), said zone of ions being adapted to neutralize and reverse the polarity of a portion of the charged particles yielding a plurality of diversely charged particles; and, third means (21) for continuously varying the charge applied to said electrode (16) over a range that includes said first level and a second level of a magnitude insufficient for maintaining said zone of ions.

2. The electrodynamic coating apparatus (10), as set forth in claim 1, wherein said third means (21,22) includes a high voltage waveform generator (21).

3. The electrodynamic coating apparatus (10), as set forth in claim 2, wherein said electrode (16) is in electrical contact with said high voltage waveform generator (21), said electrode (16) being proximate said nozzle (24).

4. The electrodynamic coating apparatus (10), as set forth in claim 3, wherein said high voltage waveform generator (21) is of a construction sufficient for applying a voltage of varying magnitude and polarity to said electrode (16).

5. The electrodynamic coating apparatus (10), as set forth in claim 3, wherein the magnitude of the voltage applied to said electrode (16) is at least periodically sufficient to establish a negative corona and wherein said electrode (10) is in the range of between 12 and 25 millimeters from said nozzle (24).

6. An electrodynamic coating apparatus (10) for coating a workpiece (15) with a coating material, said apparatus comprising:

first means (13) for propelling a plurality of atomized particles of said coating material through space in a preselected spray pattern (26), said first means (13) having a gun body (30) and a nozzle (24) connected to the gun body (30); and, second means (16,21,34), including an electrode (16), for imparting an initial electric charge to a plurality of said atomized particles and for establishing a varying electric field between the nozzle (24) and the electrode (16), said second means (16,21,34) including a high voltage waveform generator (21) having a discharge circuit (43) and a D.C. high voltage power supply (34) having an output grounded through a discharge circuit (43), said discharge circuit (43) including a capacitor (38) and an air gap (42) in parallel, and having a second resistor (40) in parallel with said capacitor (38) and in series with said air gap (42).

7. The apparatus (10), as set forth in claim 6, wherein the product of the values of said capacitor (38) and said second resistor (40) is in the range of between about 0–2 seconds.

8. The apparatus (10), as set forth in claim 7, wherein said apparatus includes a first resistor (36) in series with said power supply (34) and said discharge circuit (43), said first resistor (36), said second resistor (40), said capacitor (38) and said air gap (42) being of values sufficient for permitting discharge across said air gap (42) to occur with a period in the range of between about 0–2 seconds.

9. The apparatus (10), as set forth in claim 6, wherein said first resistor (36) is in direct electrical contact with said electrode (16).

10. In an electrodynamic coating apparatus (10) for coating a workpiece (15) with a coating material, said apparatus having first means (13) for propelling a plurality of atomized particles of said coating material through space in a preselected spray pattern (26), said first means (13) having a gun body (30) and a nozzle (24) connected to the gun body (30), the improvement comprising:

second means (16,34) including an electrically chargeable electrode (16) for establishing an electric field intermediate the nozzle (24) and the electrode (16) for imparting an initial electrical charge of one polarity to the plurality of atomized particles at the nozzle (24), and for establishing, in response to the electrode (16) being charged to a sufficiently great first level, a zone of ions of an opposite polarity to said one polarity in the pathway of at least a portion of the preselected spray pattern (26), said zone of ions being adapted to neutralize and reverse the polarity of a portion of the charged particles yielding a plurality of diversely charged particles; and, power supply means (22) for establishing a charge of varying magnitude on the workpiece (15), said power supply means (22) being in electrical contact with said workpiece (15).

11. The apparatus (10), as set forth in claim 10, wherein said means (22) for establishing a charge of varying magnitude on the workpiece (15) includes a high voltage waveform generator adapted for applying to said workpiece (15) an oscillating voltage having a maximum magnitude of at least about 100 kilovolts and cyclically falling to about zero kilovolts.

12. The apparatus (10), as set forth in claim 10, wherein said means (22) for establishing a charge of varying magnitude on the workpiece (15) includes a discharge circuit (43), and is adapted for cyclically varying the polarity of the voltage applied to said workpiece (15).

13. A method for coating a workpiece (15) with a coating material, comprising the steps of:

establishing a cyclically varying first electric field proximate a spary nozzle (24), said spray nozzle (24) being adapted to accept a surface charge, said surface charge being of a strength and polarity dependent upon said electric field;

spraying said coating material from said nozzle (24) toward said workpiece (15); and creating a periodic corona in the path of at least a portion of said coating material.

14. The method, as set forth in claim 13, including the steps of charging said workpiece (15) and cyclically bring the strength of said first electric field to substantially zero.

15. An electrodynamic coating apparatus (10) for coating a workpiece (15) with a coating material, comprising:

first means (13) for propelling a plurality of atomized particles of said coating material through space in a preselected spray pattern (26);

second means (16,34) for establishing an electric field positioned such that at least a portion of said spray pattern (26) passes through said electric field, said second means (16,34) being adapted for cooperating with said first means (13) for imparting an initial electric charge to a plurality of said atomized particles at the origin of said spray pattern (26); and, third means (21,43) for continuously varying the strength of the electric field such that a corona is repeatedly created and destroyed at a position at least partially located within the space occupied by said spray pattern (26).

16. The electrodynamic coating apparatus (10), as set forth in claim 15, wherein said first means (13) includes a nozzle (24) and said second means (16,34) includes an electrode (16) electrically insulated from said nozzle (24).

17. The electrodynamic coating apparatus (10), as set forth in claim 16, wherein said nozzle (24) is adapted for receiving a surface charge from said electrode (16) in response to said electrode (16) being charged.

18. The electrodynamic coating apparatus (10), as set forth in claim 17, wherein said third means (21,43) includes a high voltage waveform generator (21).

19. The electrodynamic coating apparatus (10), as set forth in claim 18, wherein said voltage waveform generator (21) is adapted for charging said electrode (16) between a positive and a negative polarity condition.

20. The electrodynamic coating apparatus (10), as set forth in claim 19, wherein said high voltage waveform generator (21) is adapted for periodically establishing a negative corona condition proximate said electrode (16).

21. The electrodynamic coating apparatus (10), as set forth in clam 16, wherein said nozzle (24) is electrically conductive and is grounded.

22. The electrodynamic coating apparatus (10), as set forth in claim 18, wherein said high voltage waveform generator (21) includes a discharge circuit (43) and a D.C. high voltage power supply (34) having an output grounded through said discharge circuit (43).

23. The electrodynamic coating apparatus (10), as set forth in claim 22, wherein said discharge circuit (43) includes a capacitor (38) and an air gap (42) in parallel.

24. The apparatus (10), as set forth in claim 23, wherein said dicharge circuit (43) further includes a second resistor (40), said second resistor (40) being in parallel with said capacitor (38) and in series with said air gap (42).

25. The apparatus (10), as set forth in claim 24, wherein the product of the values of said capacitor (38) and said second resistor (40) is in the range of between about 0–2 seconds.

26. The apparatus (10), as set forth in claim 25, wherein said apparatus includes a first resistor (36) in series with said power supply (34) and said discharge circuit (43), said first resistor (36), said second resistor (40), said capacitor (38) and said air gap (42) being of values sufficient for permitting discharge across said air gap (42) to occur with a period in the range of between about 0–2 seconds.

27. The apparatus (10), as set forth in claim 26, wherein said first resistor (36) is in direct electrical contact with said electrode (16).

28. A method of electrostatically coating a workpiece (15) with a liquid paint, comprising:

projecting the paint from a gun nozzle (24) of a gun (30) in a plurality of atomized particles in a preselected spray pattern (26), said gun (30) having an electrode (16) insulated therefrom and so spaced from the nozzle (24) and so shaped as to be capable of generating a corona discharge in its vicinity when adequately charged;

establishing a recurring first condition in which a first electric field exists between the electrode (16) and the nozzle (24), said electric field being sufficient for both imparting an initial electric charge of one polarity to the plurality of atomized paint particles at the nozzle (24) and for generating a corona discharge; and establishing during said first condition a zone of ions in said corona discharge at the electrode (16) in the pathway of the preselected spray pattern (16) sufficient for thereafter neutralizing and reversing the polarity of a portion of the charged particles emanating from said nozzle (24) and providing a plurality of diversely charged particles;

establishing a recurring second condition in which a second electric field exists between the electrode (16) and the nozzle (24), said second electric field being free from being sufficient for generating a corona discharge in the pathway of the preselected spray pattern (16);

alternating between said first and second conditions; and electrically charging said workpiece (15).

29. The method, as set forth in claim 28, including the step of: varying the charge of said workpiece (15) in an oscillating manner.

* * * * *